US007431815B2

(12) United States Patent
Chen et al.

(10) Patent No.: US 7,431,815 B2
(45) Date of Patent: Oct. 7, 2008

(54) METHOD TO REDUCE FERRIC IONS IN FERROUS BASED PLATING BATHS

(75) Inventors: Chao-Peng Chen, Fremont, CA (US); Jas Chudasama, Gilroy, CA (US); Situan Lam, San Jose, CA (US)

(73) Assignee: Headway Technologies, Inc., Milpitas, CA (US)

( * ) Notice: Subject to any disclaimer, the term of this patent is extended or adjusted under 35 U.S.C. 154(b) by 330 days.

(21) Appl. No.: 11/122,847

(22) Filed: May 5, 2005

(65) Prior Publication Data

US 2006/0249392 A1 Nov. 9, 2006

(51) Int. Cl.

| | |
|---|---|
| ***C25D 21/06*** | (2006.01) |
| ***C25D 21/18*** | (2006.01) |
| ***C25D 3/20*** | (2006.01) |
| ***C25D 3/56*** | (2006.01) |

(52) U.S. Cl. ..... 205/98; 205/99; 205/101; 205/255; 205/270

(58) Field of Classification Search ..... 205/255, 205/270, 98, 99, 101, 225
See application file for complete search history.

(56) References Cited

U.S. PATENT DOCUMENTS

| | | | | |
|---|---|---|---|---|
| 3,141,837 | A * | 7/1964 | Edelman | 205/82 |
| 3,969,198 | A | 7/1976 | Law et al. | 204/43 T |
| 5,173,170 | A | 12/1992 | Brown et al. | 205/96 |
| RE34,191 | E | 3/1993 | Brown | 205/96 |
| 5,607,743 | A * | 3/1997 | Disselbeck | 428/131 |
| 5,883,762 | A | 3/1999 | Calhoun et al. | 360/113 |
| 5,932,082 | A | 8/1999 | Harris et al. | 205/259 |
| 2004/0217007 | A1 | 11/2004 | Diel et al. | 205/101 |

OTHER PUBLICATIONS

Co-pending, U.S. Patent HT-03-042, U.S. Appl. No. 10/860,716, filed Jun. 3, 2004, "Electrodeposition of FeCoNiV Films with High Resistivity and High Satuvation Magnetization," assigned to the same assignee.

"A High Moment CoFe Soft Magnetic Thin Film Prepared by Electro deposition," Osaka et al., Elec. & Solid St. Lts., 6(4), pp. C53-C55, 2003.

* cited by examiner

*Primary Examiner*—Edna Wong
(74) *Attorney, Agent, or Firm*—Saile Ackerman LLC; Stephen B. Ackerman

(57) ABSTRACT

A process for cathodically reducing unwanted $Fe^{+3}$ ions to needed $Fe^{+2}$ ions in an acidic ferrous based plating bath without reducing agents is disclosed. An auxiliary potential of 0.1 to 0.3 volts vs. SCE is applied between the working electrode and a reference electrode and can reduce the molar ratio $[Fe^{+3}]/[Fe^{+2}]$ to 1 ppm without depositing Fe or other metals on the working electrode or causing hydrogen evolution. The process is applicable to electroplating soft magnetic films such as NiFe, FeCo, and CoNiFe and can be performed during plating or during cell idling. The process is cost effective by reducing the amount of hazardous waste and tool down time due to routine solution swap. Other benefits are improved uniformity in composition and thickness of plated films because issues associated with decomposed reducing agents are avoided.

20 Claims, 2 Drawing Sheets

METHOD TO REDUCE FERRIC IONS IN FERROUS BASED PLATING BATHS

RELATED PATENT APPLICATION

This application is related to the following: Ser. No. 10/860,716, filing date Jun. 3, 2004; assigned to a common assignee.

FIELD OF THE INVENTION

The invention relates to an electroplating method involving a ferrous based plating bath and in particular to a technique for converting unwanted ferric ions ($Fe^{+3}$) into needed ferrous ions ($Fe^{+2}$) without the addition of any reducing agents.

BACKGROUND OF THE INVENTION

Electroplating methods are commonly used in numerous applications such as depositing metal films (copper interconnects) in semiconductor devices and forming magnetic layers in magnetic recording devices. Although magnetic layers in read and write heads may be deposited by a sputtering method, an electroplating process is usually preferred because the sputtering process produces a magnetic layer with a large magnetocrystalline anisotropy and higher internal stress. Electroplating is capable of generating a magnetic layer with a smaller crystal grain size and a smoother surface that leads to a high magnetic flux density ($B_s$) value and low coercive force ($H_c$).

In an electroplating process, an electric current is passed through an electroplating cell comprised of a working electrode (cathode), counter electrode (anode), and an aqueous electrolyte solution of positive ions of the metals to be plated on a substrate in physical contact with the cathode. By applying a potential to the electrodes, an electrochemical process is initiated wherein cations migrate to the cathode and anions migrate to the anode. Metallic ions such as $Fe^{+2}$, $Co^{+2}$, and $Ni^{+2}$ deposit on a substrate (cathode) to form an alloy that may be NiFe, CoFe, or CoNiFe, for example. The substrate typically has an uppermost seed layer on which a photoresist layer is patterned to provide openings over the seed layer that define the shape of the metal layer to be plated. Once the metal layer is deposited, the photoresist layer and underlying seed layer are removed. The magnetic layers which become a bottom pole layer and top pole layer in a write head can be formed in this manner.

Magnetically soft materials in data storage are widely produced by electroplating from ferrous-based solutions. In the plating processes, ferrous ions are consumed by cathodic reduction reactions to form binary or ternary alloys such as NiFe, CoFe, and CoNiFe. However, ferrous ions are also converted to ferric ions either at the anode during plating or by homogeneous oxidation with dissolved oxygen. Formation of ferric ions can reduce plating current efficiency and adversely affect the surface morphology of the plated films. The presence of ferric ions can also result in poor plating thickness uniformity. In addition, the accumulation of ferric ions in the plating bath can lead to precipitation of ferric hydroxide within filters that remove particles from the electrolyte solution. As a result, mass transfer and/or solution flow to the plating cells is retarded. Ferric hydroxide can also be co-deposited into the plated films. High magnetic moment materials required for high areal density read/write heads are generally plated from a plating bath containing a high concentration of ferrous ions. Unfortunately, a high concentration of ferrous ions can accelerate the conversion process to cause an accumulation of ferric ions in the plating bath.

Conventionally, unwanted ferric ions can be reduced by periodically swapping aged plating solution. However, this practice is expensive because it creates hazardous waste and increases tool down time. Undesired ferric ions can also be suppressed by the addition of reducing agents such as trimethylamineborane (TMAB) as stated by T. Osaka, et al, Electrochemical and Solid State Letters, Vol. 6, No. 4, C53-C55 (2003). However, reducing agents that decompose during plating can be co-deposited into the plated films. The incorporation of decomposed components in a plated magnetic film can reduce the magnetic moment thereof due to dilution. The corrosion resistance of the plated film could also be lowered and cause defects in the resulting magnetic recording device. Another undesirable property of reducing agents is that they can interact with other chemical components in the plating bath and thereby cause changes in film composition and in the associated chemical-physical properties.

A method described in U.S. Patent Application Publication No. 2004/0217007 involves reducing ferric ion content in a plating solution by exposing hydrogen to an electrode that may be positioned in a plating cell or plating reservoir. However, $Fe^{+3}$ content is only lowered by a few parts per million (ppm) per day using this technique.

In U.S. Pat. No. 5,932,082, a small amount of tartrate ions is added to a plating bath to prevent the precipitation of ferric hydroxide. However, this method does not address the need to convert unwanted ferric ions to ferrous ions.

A process for electroplating metals is disclosed in U.S. Pat. No. 5,173,170 in which a second anode that is insoluble is used to prevent metal build up in the plating bath. In a related Pat. No. Re. 34,191, an electroplating system comprised of an electrowinning cell having an insoluble anode, insoluble cathode, and a bath that communicates with the electroplating bath is described as a means of preventing metal build up. Unfortunately, there is no provision to reduce ferric ion content in the plating solution.

A method is described in U.S. Pat. No. 3,969,198 that slows the conversion of ferrous ions to ferric ions by oxidation. Additives such as sodium bisulphate, sodium benzene sulphinate and sodium para-toluene are employed for this purpose but may be depleted during the bath life. Additives can lead to other complications and require monitoring to ensure the proper concentration is maintained which leads to higher cost.

In U.S. Pat. No. 5,883,762, a cation-selective semi-permeable membrane is used to separate anode and cathode compartments and thereby block transport of oxidizable cations and anions to the anode. However, this method requires the additional activities of monitoring and manipulating the concentration of non-oxidizable plating cations in the anolyte and catholyte solutions. Therefore, an improved method of reducing ferric ions that does not involve reducing agents or modification of the electroplating cell is needed for ferrous based electroplating baths.

SUMMARY OF THE INVENTION

One objective of the present invention is to provide a process for converting $Fe^{+3}$ ions to $Fe^{+2}$ ions in an electroplating bath without using reducing agents.

A further objective of the present invention is to provide a process according to the first objective that is applicable to the deposition of soft magnetic alloys such as NiFe, CoFe, and CoNiFe.

A still further objective of the present invention is to provide a process according to the first objective that does not involve modification of the electroplating bath or additional monitoring of its components.

Yet another objective of the present invention is to provide an electroplating process which minimizes hazardous waste and tool down time that result from routine replacement of the electrolyte bath.

According to one embodiment of the present invention, an electroplating system is provided that comprises an electroplating cell having an anode and a cathode (working electrode) which are immersed in an electrolyte solution that includes metal cations of the metals to be plated on a substrate. A reference electrode with a stable, fixed voltage is also provided. Furthermore, there is a power source (potentiostat) with leads affixed thereto wherein one lead connects to the anode and supplies a positive voltage and a second lead connects to the cathode to provide a negative voltage when the cell is operating. A third lead connects to the reference electrode. A key feature is the application of an auxiliary potential between the cathode and reference electrode. An auxiliary potential is applied during the electroplating process to control the degree of $Fe^{+3}$ to $Fe^{+2}$ conversion by cathodic reduction. In particular, the molar ratio $[Fe^{+3}]/[Fe^{+2}]$ can be maintained in a range of from 1 ppm to 500 ppm by keeping the auxiliary potential between 0.1 and 0.3 volts vs. a standard calomel electrode (SCE).

In a second embodiment of the present invention, an auxiliary potential as described previously is applied during a cell idling period. In other words, the conversion process may be performed when there is no potential between the cathode and anode and electroplating is stopped temporarily to remove a plated substrate and introduce a fresh substrate into the cell. In both embodiments, the electrolyte solution is stirred to promote circulation of bath components and an acceptable temperature range is maintained.

DETAILED DESCRIPTION OF THE INVENTION

Figure 1:
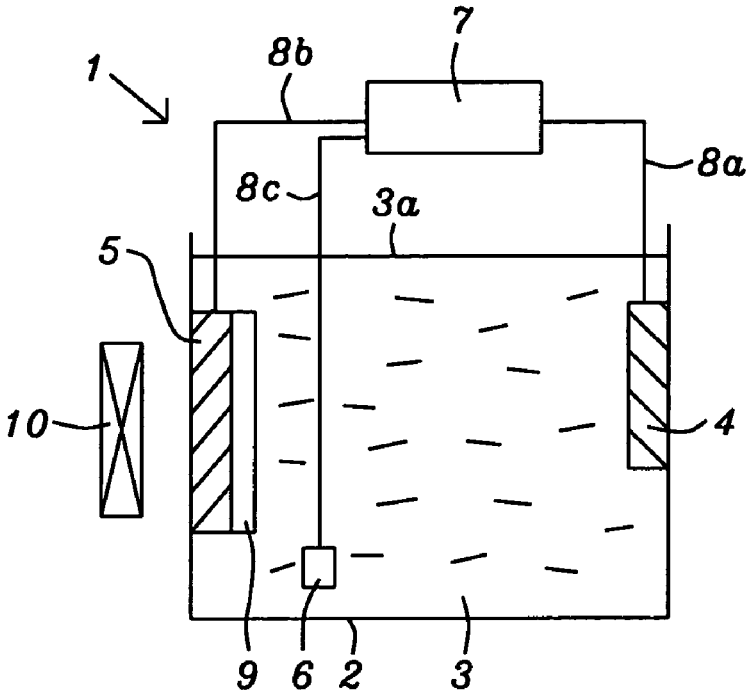
FIG. 1 is a sectional view illustrating an example of an electroplating system that could be used in the process of the present invention.

The present invention is an electroplating process involving a ferrous-based plating bath in which unwanted $Fe^{+3}$ ions are converted to needed $Fe^{+2}$ ions without using a reducing agent. The electroplating process may be used to form magnetic layers such as bottom and top pole layers in magnetic recording devices or cladding layers on word lines in MRAM devices as appreciated by those skilled in the art. The drawings are provided by way of example and are not intended to limit the scope of the invention. For example, FIG. 1 shows an example of an electroplating cell configuration that may be employed to carry out the process of the present invention. However, other conventional electroplating cells such as commercially available electroplating systems are also acceptable.

The inventors have surprisingly found that when an auxiliary potential is applied between a working electrode (cathode) and a reference electrode during electroplating or during a cell idling period according to a process described herein, the concentration of $Fe^{+3}$ ions in the electroplating bath is dramatically reduced.

It should be understood that the magnetic layer deposited according to the present invention is preferably formed on a seed layer (not shown) disposed on a substrate. For example, the substrate may be a write gap layer in a partially formed write head. The seed layer may be deposited by a sputtering process and preferably has the same composition as intended for the subsequently formed magnetic layer. Typically, the fabrication process involves forming a seed layer on a substrate and then patterning a photoresist layer on the seed layer to define openings that dictate the shape of the magnetic layer. The seed layer promotes the deposition of the magnetic layer during the electroplating process. Once the magnetic layer is plated, the photoresist layer and underlying portions of the seed layer are removed.

In one aspect, the magnetic layer is comprised of a soft magnetic material having a certain thickness and is a binary or ternary alloy such as FeCo, NiFe, CoNiFe, or FeCoN. Optionally, the magnetic layer may be made of other Fe alloys as appreciated by those skilled in the art. One example is FeCoNiV that is described in Headway patent application HT03-042 which is herein incorporated by reference. When the magnetic layer is a pole layer in a write head, the certain thickness is about 3 to 6 microns.

Referring to FIG. 1, one example of an electroplating system 1 is shown in which the present invention may be performed. The electroplating system 1 is comprised of a container 2 such as a tank and an electrolyte solution 3 having a top surface 3*a* contained therein. There is a means such as a pump and paddle for circulating the electrolyte solution 3 and a reservoir to replenish the solution that are not shown. The electrolyte solution 3 is aqueous based and is comprised of $Fe^{+2}$ and one or more other metal cations such as $Ni^{+2}$ and $Co^{+2}$ that are added as chloride and/or sulfate salts. Boric acid ($H_3BO_3$) may be added to buffer the electrolyte solution 3 and thereby maintain a pH in the range of 2.0 to 4.0. Other additives may be employed to optimize the performance of the electrolyte solution. For example, saccharin can be used as a stress reducing agent and sodium lauryl sulfate may serve as a surfactant. In one embodiment, the electrolyte solution 3 is mechanically agitated by a rotating paddle or the like during the electroplating process. Furthermore, either a direct current (DC) or pulsed DC mode may be used with a duty ratio of about 0.4 to 0.6 and a cycle time of about 100 ms to supply a current that powers the electroplating process.

There is a counter electrode (anode) 4 and a working electrode also known as a cathode 5 immersed or otherwise positioned in the electrolyte solution 3. When a CoNiFe or NiFe magnetic layer is electroplated, the anode 4 is preferably Co or Ni and a positive potential is applied thereto. In an embodiment where a FeCo alloy is electroplated, the anode 4 may be comprised of Co. The cathode 5 may be a dimensionally stable electrode such as Pt or gold mesh to which a negative potential is applied. In other words, a potential hereafter referred to as an electroplating potential is established between the anode 4 and cathode 5 whereby an electric current flows from the anode to the cathode to drive the electroplating process. The substrate 9 is preferably in good electrical contact with the cathode 5 and is affixed thereto by a clamp or other conventional means. Although the anode 4 and cathode 5 (and substrate 9) are shown opposed to each other on opposite walls of the container 2, the anode and cathode may optionally be arranged in other configurations. For instance, the anode and cathode may have their top and bottom surfaces aligned parallel to the top surface 3*a* of the electrolyte solution. The substrate 9 and specifically a seed layer thereon that is exposed through openings in a photoresist pattern (not shown) functions as a cathode during the electroplating process.

The anode 4 and cathode 5 are connected to a potentiostat (power source) 7 by electrical leads 8*a* and 8*b*, respectively. There is also a reference electrode 6 immersed in the electrolyte solution 3 and connected to the potentiostat 7 by a lead 8*c*. Preferably, the reference electrode 6 is positioned in the vicinity of the anode 4. The reference electrode 6 may be a standard calomel electrode (SCE) comprised of $Hg/HgCl_2$ in a KCl electrolyte or may be a silver/silver chloride electrode as appreciated by those skilled in the art.

Another feature shown in FIG. 1 is a magnetic field generator 10 that is located adjacent to the container 2 near the cathode 5. The magnetic generator 10 may be used to influence the magnetic orientation of a magnetic layer (not shown) which is deposited on the substrate 9 during the electroplating process.

In one embodiment wherein a CoNiFe alloy is electroplated on a substrate, the electrolyte solution is an aqueous solution having a pH between 2.0 and 4.0 and includes $Fe^{+2}$ ions, $Co^{+2}$ ions, and $Ni^{+2}$ ions which are provided by adding the following metal salts to deionized water at the indicated concentrations in grams per liter: $FeSO_4.7H_2O$ (30 to 70 g/L); $CoSO_4.7H_2O$ (10 to 40 g/L); $NiSO_4.6H_2O$ (0 to 40 g/L); and $NiCl_2.6H_2O$ (0 to 10 g/L). At least one of $NiSO_4.6H_2O$ and $NiCl_2.6H_2O$ is used to provide the $Ni^{+2}$ ions. Additionally, the electrolyte solution may be comprised of other additives and supporting electrolytes including but not limited to $H_3BO_3$ with a concentration of 26 to 27 g/L, $NH_4Cl$ at a concentration of 0 to 20 g/L, $(NH_4)_2SO_4$ at a concentration of 0 to 30 g/L, sodium saccharin at a concentration of 0 to 2.0 g/L, and sodium lauryl sulfate at a concentration of 0.01 to 0.15 g/L. Preferably, the electroplating is performed with an electrolyte solution temperature between 10° C. and 35° C. and with a plating current density of from 3 to 30 $mA/cm^2$. Using these conditions, a magnetic layer comprised of CoNiFe is deposited at the rate of about 50 to 700 Angstroms per minute A key feature of the present invention is the application of an auxiliary potential at the cathode 5 which is supplied by the potentiostat 7 and can be measured with respect to the reference electrode 6. The potentiostat 7 may be a model 273A available from EG&G company. In one embodiment, the auxiliary potential is applied by a DC current during electroplating of a Fe based alloy on a substrate 9 that is in electrical contact with the cathode 5. For example, the auxiliary potential may be applied for the same period of time as the electroplating potential between the anode 4 and cathode 5. Alternatively, the auxiliary potential may be applied for a shorter length of time than the electroplating potential. The present invention also encompasses a process where the auxiliary potential is cycled on and off during electroplating. The application of an auxiliary potential according to the present invention causes $Fe^{+3}$ ions to be cathodically reduced to $Fe^{+2}$ ions without deposition of iron or other metals on the working electrode.

Figure 2:
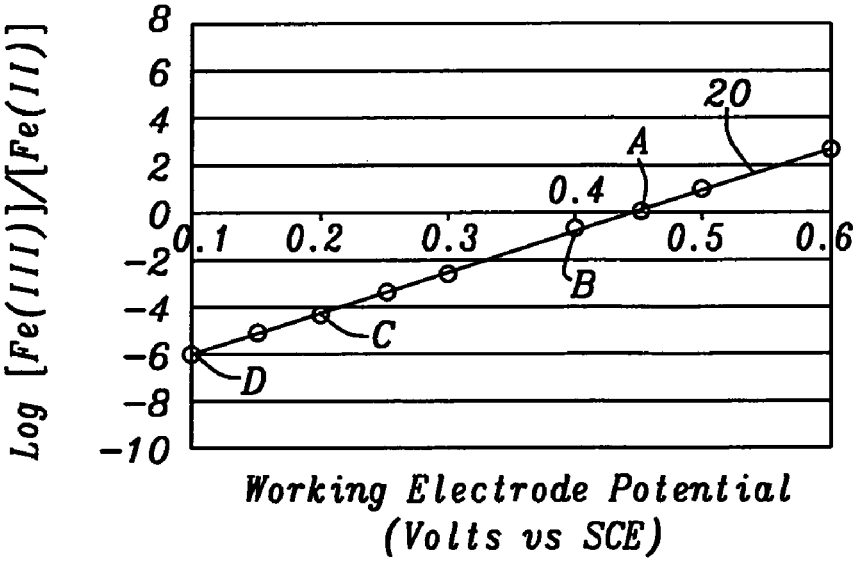
FIG. 2 is a plot that shows the relationship between the molar ratio $[Fe^{+3}]/[Fe^{+2}]$ and the working electrode potential according to an embodiment of the present invention.

Referring to FIG. 2, an experiment was performed to determine the optimum range of the auxiliary potential for an acidic CoNiFe plating solution by employing an electro-plating cell configuration as represented in FIG. 1. The starting point for generating the line 20 is at point A where the cell was charged with an electroplating solution 3 comprised of $Fe^{+2}$ ions with a concentration of 0.06 mole/liter (M) and $Fe^{+3}$ ions having a concentration of 0.06 M to give a molar ratio $[Fe^{+3}]/[Fe^{+2}]=1$. The electric potential of the working electrode (cathode) 5 at point A is measured to be 0.45 volts vs. SCE.

When an auxiliary potential of 0.39 volts vs. SCE is applied to the working electrode 5 by the potentiostat 7, unwanted $Fe^{+3}$ ions are converted to $Fe^{+2}$ ions and the molar ratio $[Fe^{+3}]/[Fe^{+2}]$ drops to 0.1 at point B after reaching equilibrium. Note that the period of time required to reach equilibrium depends on bath volume. The concentrations of $Fe^{+3}$ and $Fe^{+2}$ ions were measured by titration or an atomic absorption (AA) method. If an auxiliary potential of 0.20 volts vs. SCE is applied, a greater number of $Fe^{+3}$ ions are converted to $Fe^{+2}$ ions and the molar ratio $[Fe^{+3}]/[Fe^{+2}]$ decreases from 0.1 to 0.0001 (point C) after an equilibrium state is reached. It should be understood that the molar ratio $[Fe^{+3}]/[Fe^{+2}]$ can be reduced from 1 to 0.0001 by applying an auxiliary potential of 0.20 volts vs. SCE without employing the intermediate step of applying an auxiliary potential of 0.39 volts vs. SCE. Starting at point A, the molar ratio $[Fe^{+3}]/[Fe^{+2}]$ can be lowered to 1 ppm (point D) by applying an auxiliary potential of 0.1 volts vs. SCE to the working electrode. Further auxiliary potential reduction below 0.1 volts vs. SCE can result in side reactions such as hydrogen evolution and/or other metal ion deposition and therefore is not desirable. Thus the degree of $Fe^{+3}$ ion conversion to $Fe^{+2}$ ions is determined by the magnitude of the applied auxiliary potential of the working electrode. We have discovered that when using ferrous-based solutions for plating NiFe, CoFe, or CoNiFe alloys, the preferred auxiliary potential range is 0.1 to 0.3 volts vs. SCE.

In a second embodiment, the auxiliary potential described previously is applied during an idling period when an electroplating process is not being performed in the electrolyte solution 3. Generally, the idling period is defined as the time between completion of the electroplating process on a first substrate and initiating the electroplating process on a second substrate that is next in succession to be processed. The first and second substrates are preferably not in the electrolyte solution when the auxiliary potential is applied in order to improve throughput.

Figure 3:
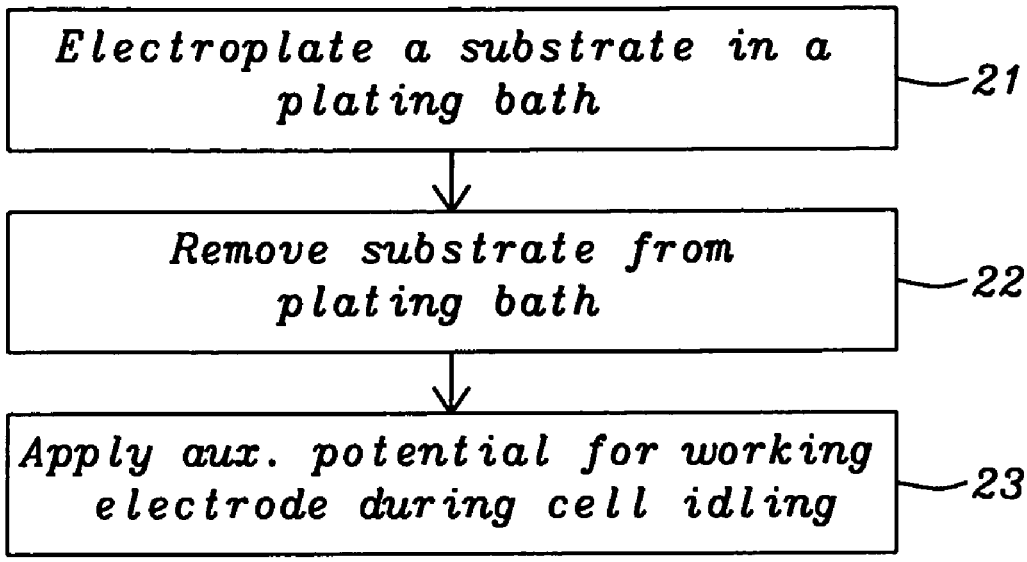
FIGS. 3-4 are flow diagrams that represent a second embodiment of performing the process of the present invention.

In FIG. 3, a representative process flow is depicted for the second embodiment. In step 21, a first substrate in contact with a working electrode is electroplated in an electroplating cell. Typically, a period of 1 to 50 minutes is necessary for electroplating to deposit the desired thickness of a magnetic layer on a substrate. Thereafter, the first substrate is removed from the electroplating cell in step 22. Those skilled in the art will appreciate that a substrate is typically rinsed with DI water and dried after removal from the electroplating cell and prior to subsequent processing. In step 23, an auxiliary potential of about 0.1 to 0.3 volts vs. SCE is applied to the working electrode during a cell idling period before the next substrate is secured to the cathode and electroplated. Next, steps 21 through 23 are repeated with a second substrate. Note that steps 21-23 are repeated for each substrate that is electroplated.

Figure 4:
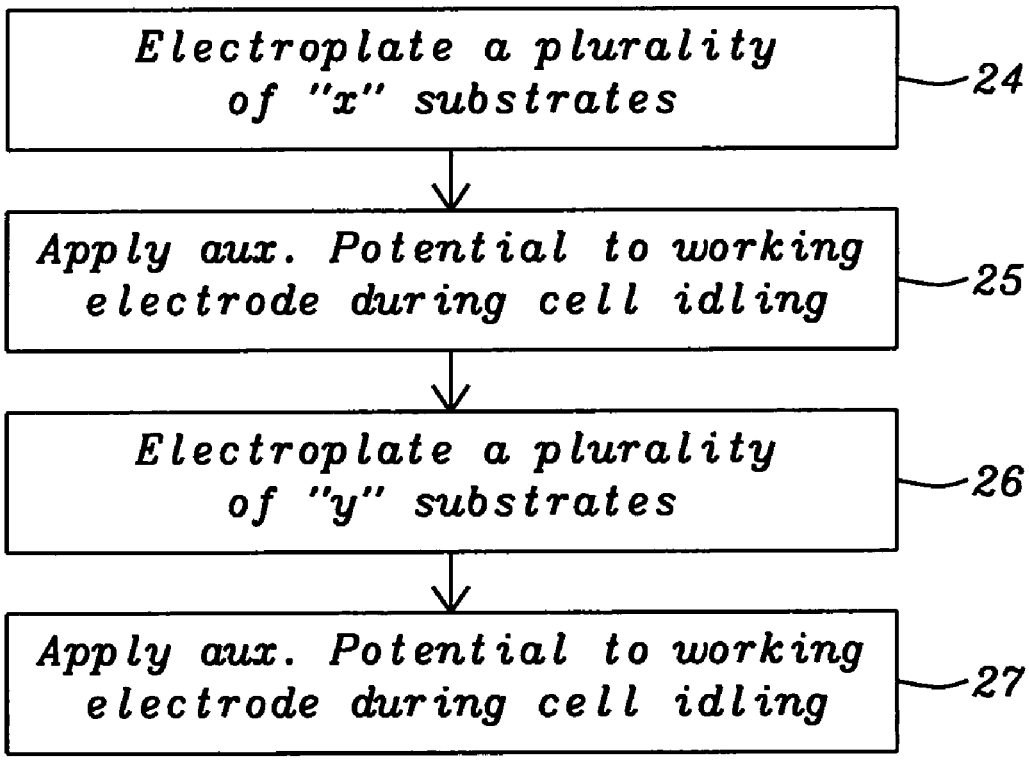

Another representative process flow of the second embodiment is shown in FIG. 4. In step 24, a plurality of "x" substrates are electroplated in a plating bath and removed before an auxiliary potential is applied to the working electrode during a cell idling period in step 23 to lower the molar ratio $[Fe^{+3}]/[Fe^{+2}]$ in the electroplating bath. The auxiliary potential is stopped after a certain period of time and then in step 25, a plurality of "y" substrates are electroplated and removed from the electroplating bath. Note that "y" is not necessarily equal to "x". Next, an auxiliary potential of about 0.1 to 0.3 volts vs. SCE is applied to the working electrode in step 23 for a certain period of time. Thereafter, the sequence of step 25 followed by step 23 may be performed as many times as necessary to process the required number of substrates.

One advantage of the present invention compared with prior art is that unwanted $Fe^{+3}$ ions are reduced to $Fe^{+2}$ ions without the need for reducing agents. As mentioned previously, a reducing agent can cause side reactions and purity issues. As a result of the efficient conversion of $Fe^{+3}$ ions to $Fe^{+2}$ ions, the lifetime of the electroplating bath is substantially lengthened and thereby reduces the expense of swapping the old electroplating bath for a new bath and the associated tool down time. The method as described in the first and second embodiments is applicable to electroplating a wide variety of Fe alloys including but not limited to NiFe, CoFe, CoNiFe, and CoFeN. These alloys exhibit improved physical and chemical properties such as a more controlled magnetic moment, and surface roughness reduction. Furthermore, no modifications to the plating bath or additional monitoring of its components are required. Another benefit of the implementing the process of the present invention is that plated film uniformity in terms of composition and thickness is improved compared with prior art methods.

While this invention has been particularly shown and described with reference to, the preferred embodiment thereof, it will be understood by those skilled in the art that various changes in form and details may be made without departing from the spirit and scope of this invention.

We claim:

1. A method for converting a certain number of ferric ($Fe^{+3}$) ions to ferrous ($Fe^{+2}$) ions in an electroplating bath without the addition of reducing agents, comprising:

(a) providing an electroplating system comprised of a ferrous based electroplating bath having a cathode (working electrode), anode, and reference electrode immersed therein, said cathode, anode, and reference electrode are connected to a potentiostat or power source and said cathode has a substrate affixed thereto to enable electrical contact therebetween; and (b) applying an electroplating potential between the cathode and anode for a first length of time to drive an electroplating process that deposits a Fe containing alloy on said substrate, and applying a positive auxiliary potential between the working electrode and reference electrode for a certain period of time to cathodically reduce ferric ions to ferrous ions, said auxiliary potential determines the certain number of $Fe^{+3}$ ions converted to $Fe^{+2}$ ions and is independent of the electroplating potential.

2. The method of claim 1 wherein the working electrode is a dimensionally stable electrode comprised of platinum or gold mesh.

3. The method of claim 1 wherein said Fe containing alloy is comprised of NiFe, FeCo, or CoNiFe and the electroplating bath is comprised of $Fe^{+2}$ ions and one or more of $Co^{+2}$ ions and $Ni^{+2}$ ions.

4. The method of claim 1 wherein the reference electrode is a standard calomel electrode (SCE) or is a silver/silver chloride (Ag/AgCl) electrode.

5. The method of claim 4 wherein said auxiliary potential is applied in the range of about 0.1 to 0.3 volts vs. SCE.

6. The method of claim 1 wherein said electroplating bath is maintained at a temperature between about 10° C. and 35° C. and at a pH of about 2.0 to 4.0.

7. The method of claim 3 wherein said cathode is comprised of Ni when electroplating NiFe or CoNiFe alloys or is comprised of Co when electroplating FeCo.

8. The method of claim 1 wherein the electroplating potential is applied between the anode and cathode by a direct (DC) current or pulsed current and the auxiliary potential is applied by a DC current.

9. The method of claim 1 wherein the auxiliary potential is applied concurrently with the electroplating potential such that the first length of time is equal to the certain period of time.

10. The method of claim 1 wherein the first length of time is greater than or aqual the certain period of time and overlaps the certain period of time.

11. A method for converting ferric ($Fe^{+3}$) ions to ferrous ($Fe^{+2}$) ions in an electroplating bath without the addition of reducing agents and in the absence of an electroplating potential, comprising:

(a) providing an electroplating system comprised of a ferrous based electroplating bath having a cathode (working electrode), an anode, and a reference electrode immersed therein, said cathode, anode, and reference electrode are connected to a potentiostat or power source; and said electroplating system is used to electroplate a certain number of substrates during a first period of time when an electroplating potential is applied; and (b) applying a positive auxiliary potential between the working electrode and reference electrode during a second period of time when said electroplating potential is not applied, said second period of time does not overlap with said first period of time.

12. The method of claim 11 wherein the working electrode is a dimensionally stable electrode comprised of platinum or gold mesh.

13. The method of claim 11 wherein said ferrous based electroplating bath is further comprised of $Co^{+2}$ ions and/or $Ni^{+2}$ ions.

14. The method of claim 11 wherein the reference electrode is a standard calomel electrode (SCE) or is a silver/silver chloride (Ag/AgCl) electrode.

15. The method of claim 14 wherein said auxiliary potential is applied in the range of about 0.1 to 0.3 volts vs. SCE.

16. The method of claim 11 wherein said electroplating bath is maintained at a temperature of about 10° C. to 35° C. and at a pH of about 2.0 to 4.0.

17. The method of claim 11 wherein said cathode is comprised of Ni when electroplating a NiFe or CoNiFe alloy or is comprised of Co when electroplating a FeCo alloy.

18. The method of claim 17 wherein the auxiliary potential is applied after each of the certain number of substrates is electroplated.

19. The method of claim 17 wherein a plurality of the certain number of substrates is electroplated before the auxiliary potential is applied.

20. The method of claim 11 wherein the auxiliary potential is applied when there is no substrate in the electroplating system.

* * * * *